United States Patent [19]

Marion

[11] 4,309,945

[45] Jan. 12, 1982

[54] FLEXOGRAPHIC PRINTING UNIT

[75] Inventor: Thomas E. Marion, Baltimore, Md.

[73] Assignee: Maryland Cup Corporation, Owings Mills, Md.

[21] Appl. No.: 42,980

[22] Filed: May 25, 1979

Related U.S. Application Data

[63] Continuation of Ser. No. 892,941, Apr. 3, 1978, abandoned, which is a continuation-in-part of Ser. No. 840,808, Oct. 11, 1977, abandoned.

[51] Int. Cl.[3] ..... B41F 13/14; B41F 13/32; B41F 13/40; B41L 35/12

[52] U.S. Cl. ..... 101/247; 101/248; 101/351; 101/352

[58] Field of Search ..... 101/178–185, 101/209, 247, 350, 351, 352, 209, 138, 139, 140, 143, 144, 137, 145, 218, 248; 118/258, 259

[56] References Cited

U.S. PATENT DOCUMENTS

| | | | |
|---|---|---|---|
| 743,038 | 11/1903 | Sanderson | 101/182 |
| 1,975,681 | 10/1934 | Brawn | 101/247 X |
| 2,258,653 | 10/1941 | Klingelfuss | 101/247 |
| 2,603,153 | 7/1952 | Warren et al. | 101/219 |
| 2,682,218 | 6/1954 | Baumgagner | 101/247 |
| 2,982,204 | 5/1961 | Roehm | 101/247 |
| 3,026,797 | 3/1962 | Gottscho | 101/228 |
| 3,026,798 | 3/1962 | Frostad | 101/248 |
| 3,170,315 | 2/1965 | Wippermann et al. | 101/182 X |
| 3,190,218 | 6/1965 | Willard | 101/182 X |
| 3,455,238 | 7/1969 | Gambella | 101/148 |
| 3,611,926 | 10/1971 | Johnson | 101/178 X |
| 3,902,418 | 9/1975 | Morishita et al. | 101/228 |
| 4,057,014 | 11/1977 | Thomas | 101/228 |

*Primary Examiner*—J. Reed Fisher

*Attorney, Agent, or Firm*—Birch, Stewart, Kolasch & Birch

[57] ABSTRACT

An improved flexographic type printing unit is provided in which only an ink transfer cylinder, plate cylinder and impression cylinder are needed with the transfer cylinder immersed in an ink fountain and cooperating with an adjustable doctor blade. Bearing traction roll drives and spacing means are utilized and the impression and transfer cylinders are mounted on swinging arms positioned by hydraulic or pneumatic cylinders to obviate the need for machined slides and surfaces and multiple adjustments at opposite ends of these cylinders. An eccentric structure in a freewheeling impression cylinder provides an accurate web thickness adjustment for the unit. A second embodiment of the flexographic printing unit includes a planetary gear drive for changing the registration of the print-to-blank or print-to-print of the plate cylinder as it engages a web.

32 Claims, 8 Drawing Figures

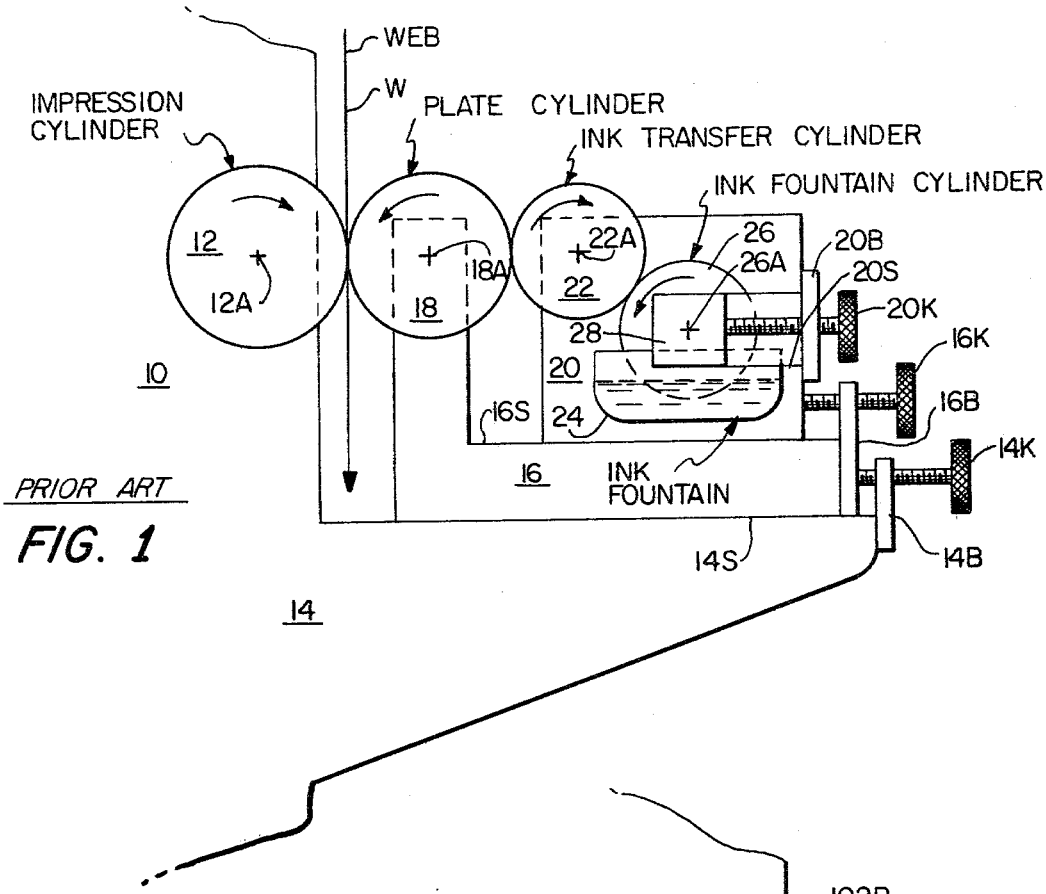
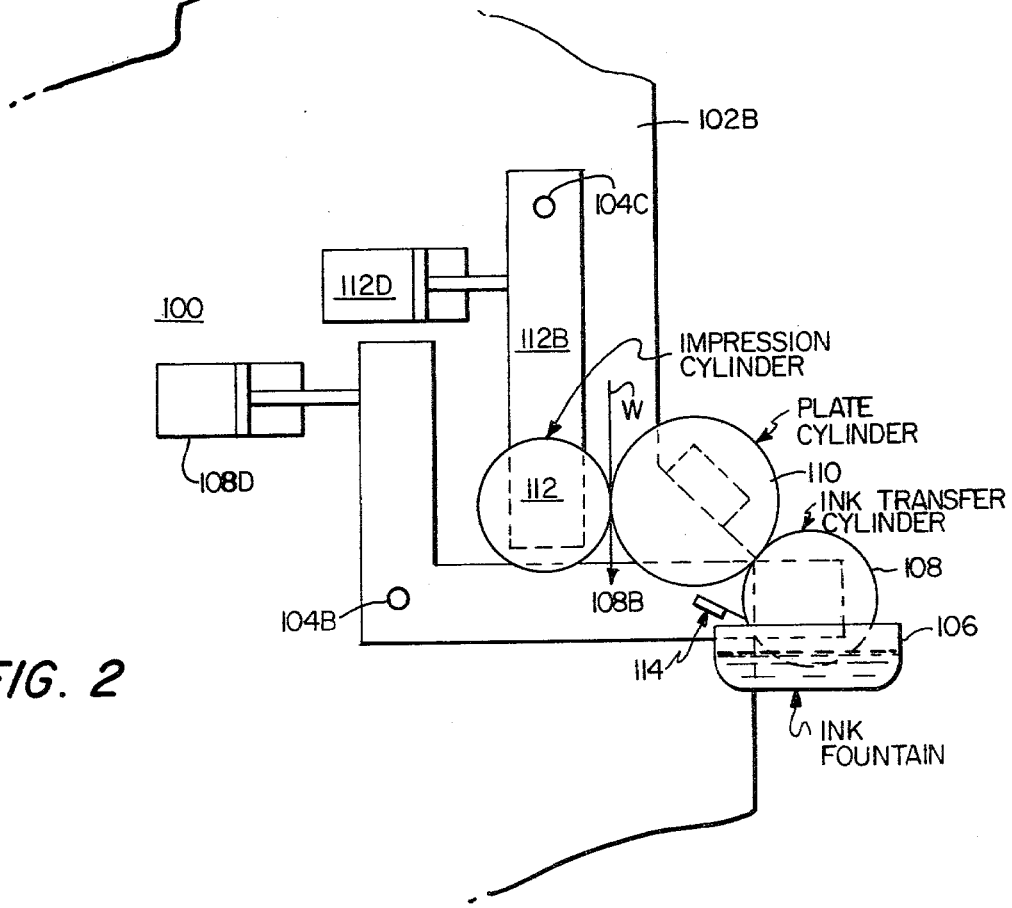
FIG. 2

FLEXOGRAPHIC PRINTING UNIT

CROSS-REFERENCE TO RELATED APPLICATIONS

This is a Continuation-In-Part of application Ser. No. 892,941, filed Apr. 3, 1978, now abandoned, Ser. No. 892,941 being a Continuation-In-Part of application Ser. No. 840,808 filed Oct. 11, 1977, now abandoned.

FIELD OF THE INVENTION

This invention relates to printing units and more particularly to the type known as flexographic printing units of increased simplicity and enhanced adjustability.

BACKGROUND OF THE INVENTION

In conventional flexographic printing units, an impression cylinder is fixed to side frames and usually driven by a miter type gear box having bevel gears therein or driven through a gear train of some desired type from the main machine drive of the unit. A plate cylinder adjacent to the impression cylinder is driven by a gear mounted on a journal of the impression cylinder and a gear mounted on the journal of the plate cylinder. An intermediate ink transfer cylinder is then driven by a gear mounted suitably on the plate cylinder shaft and a gear mounted on the journal of the intermediate transfer cylinder. An ink fountain cylinder is then driven by a gear mounted on the intermediate transfer cylinder (ITC) through a gear mounted on the journal of the ink fountain cylinder.

Ink is picked up by the fountain cylinder from an ink fountain or well and transferred to the intermediate transfer cylinder which in turn transfers ink to the plate cylinder. The thickness of the film of ink on the intermediate transfer cylinder is controlled by making the ink fountain cylinder adjustable towards and away from the intermediate transfer cylinder by means of screw mounted knobs and slides to permit the operator to squeeze the ink thickness by adjusting one side or the other or both of the fountain cylinder with respect to the intermediate transfer cylinder. A second adjustment is provided in which both the fountain cylinder and the ITC are then moved as a unit by means of slides, screws and knob units to make contacts with the printing plates mounted on the plate cylinder. One side or the other of this entire unit is permitted to be squeezed with adjusting screws by relative movement with respect to the plate cylinder. Finally, all three of these cylinders are adjustable as a unit through slides, screws and knob units, to make contact with the web to be printed which is supported by the impression cylinder. Here again, an operator can squeeze one side or the other or both in regard to the proximity of the plate and impressions cylinders to regulate the transfer of ink from the printing plates on the plate cylinder to the web to be printed.

During this conventional set up process of the flexographic unit, the operator therefore must adjust at least six screw and knob units. This results in the possibility of adjustments being either too great or too little at six different locations, causing the following additional repercussions:

1. Too much ink;
2. Not enough ink;
3. Too much pressure on the plate;
4. Not enough contact with the plate;

5. Squeezing the plates by the intermediate transfer cylinder causing premature plate wear;
6. Squeezing the plate cylinder to the web also causing premature plate wear;
7. There are three points of gear contact which if not adjusted properly, can cause excessive backlash in the gears or the gears will be too tight causing premature gear wear and bad printing.

Furthermore, the slide units for such conventional flexographic printers must be machined and mounted with a high degree of precision machining since the faces of the various cylinders must be held parallel to each other from one side of the unit to the opposite side. The slide units must also have some means of locking to prevent movement and to maintain highly accurate settings.

Accordingly, it is an object of the present invention to simplify flexographic type printing units while increasing the accuracy of adjustability thereof.

It is another object of the present invention to provide a flexographic printing unit in which the ink fountain cylinder is eliminated and in which an ink transfer cylinder is placed in the ink fountain and by means of a simplified doctor blade assembly transfers ink directly from the fountain to the plate cylinder without an intermediate transfer cylinder being used.

A still further object of the present invention is to provide a flexographic printing unit which includes a planetary gear drive unit for changing the registration of the print-to-blank or print-to-print of the plate cylinder as it engages a web.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a schematic of a flexographic printing unit of the prior art;

FIG. 2 is a schematic of the improved flexographic printing unit of the present invention;

SUMMARY OF THE INVENTION

Figure 3:
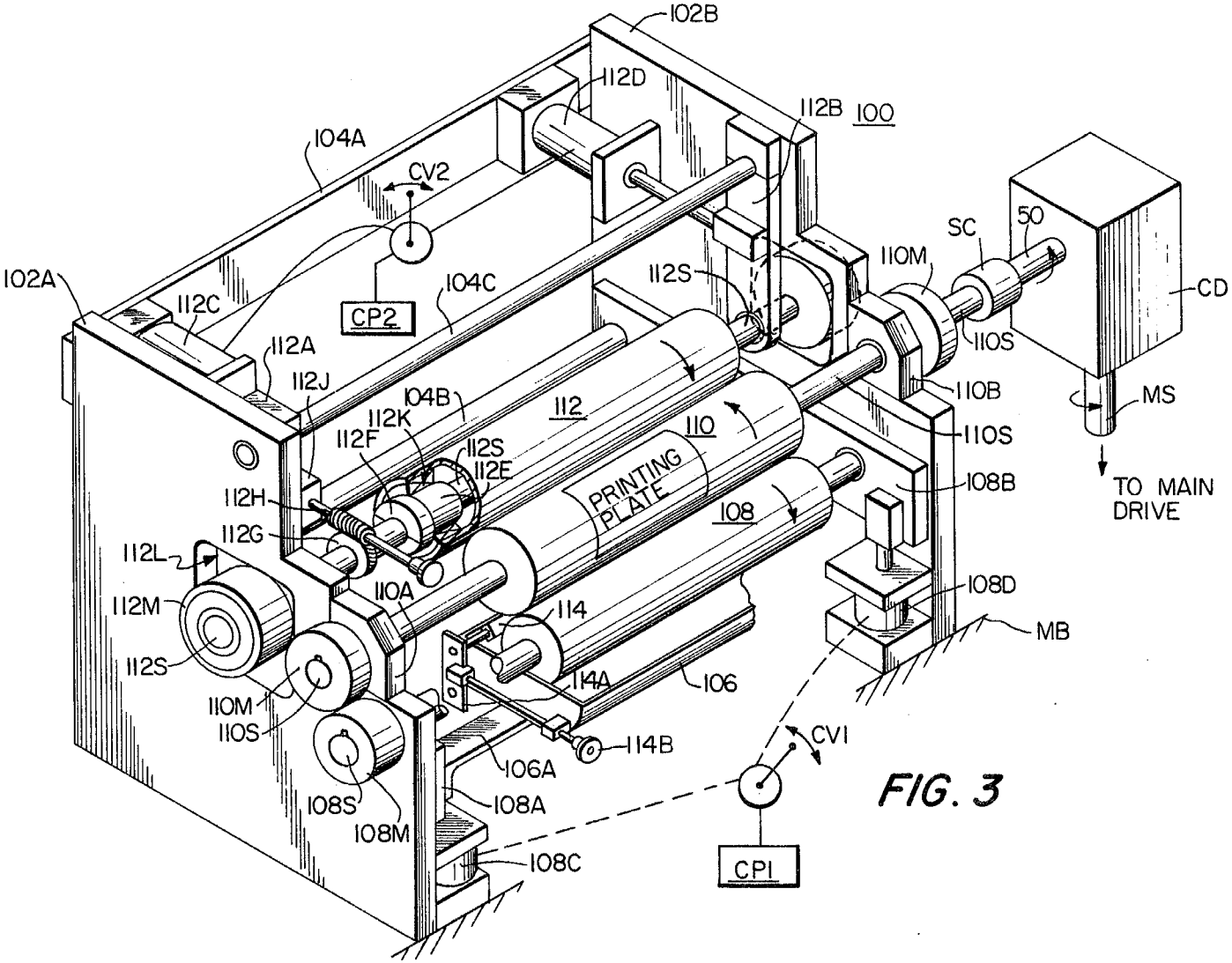
FIG. 3 is a perspective view of a flexographic printing unit of the present invention.

In the present invention, the plate cylinder is mounted into the side frame in a fixed position rather than in an adjustable position with the drive being into the shaft of the plate cylinder by means of a cone drive gear unit to minimize the backlash caused by conventional spur or helical gearing. Traction or bearer rolls ground to an exact diameter are mounted on the end journals of the plate cylinder shaft and cooperate with bearer or traction drive rolls fixed to end journals on a mounting shaft of the ink transfer cylinder and ground to the exact diameter of the transfer cylinder to cooperate with bearer rolls of like precision diameter ground either to the exact diameter of the plate cylinder or to the desired ratio between the plate cylinder and transfer cylinder.

The adjustability of the ink transfer cylinder is achieved by mounting it on a swing arm affixed to the side supports of the printing unit and which swinging arms are adjustable in position by means of pneumatic or hydraulic cylinders. A similar swinging adjustment is provided for the impression cylinder with a second pair of swinging arms in a second pair of hydraulic or pneumatic adjusting cylinders.

The impression cylinder is mounted to be freewheeling on its shaft which holds it in position. Traction or bearer drive rolls are also mounted to the same shaft on opposite ends thereof which are also freewheeling. These freewheeling traction or bearer rolls engage the traction or bearer drive rolls on the plate cylinder and the ink transfer cylinder are held parallel to the cylindrical surface on the plate cylinder by the interaction of the traction and bearer rolls. This eliminates the need for an operator to adjust the cylinders manually with reference to the plate cylinder and maintains the parallelism required for high quality printing. An eccentric shaft adjustment on the impression cylinder is provided to adjust for thickness of the web to be printed, and an adjustable doctor blade assembly is provided for controlling the ink film thickness on the ink transfer cylinder.

The use of bearer or traction roller drive means coupled with the idling bearer rolls on the impression cylinder shaft eliminates gears and assures accurate parallel settings of one cylinder relative to each of the other cylinders. Additional gear backlash and attendant inaccuracies are reduced by utilization of a cone gear drive as opposed to a cylindrical type drive means for the plate cylinder.

DETAILED DESCRIPTION OF THE DRAWINGS

Referring in detail to the drawings and with particular reference to FIG. 1, a flexographic printing unit 10 of the conventional prior art type is shown as including an impression cylinder 12 which is journaled about a shaft center 12A for rotation on a machine bed 14 above a machined first slide surface 14S which extends outwardly away from the impression cylinder 12 and terminates adjacent an upstanding fixed bracket 14B through which there extends a first adjusting knob 14K which is threaded through the bracket 14B.

Positioned on the first machine slide surface 14S is a first machine slide 16 which mounts at its uppermost extremity a plate cylinder 18 which is journal for rotation about a plate cylinder shaft 18A and which is adapted to engage the surface of the impression cylinder 12 in parallel orientation therewith. The surfaces of the said plate cylinder 18 and the impression cylinder 12 nip between them a web W to be printed.

The machine slide 16 extends along the first machine slide surface 14S into engagement with a second upstanding bracket 16B through which an additional second adjustment knob 16K is threaded. The bracket 16B is abutted on its outermost extremity by the inboard end of the first adjusting knob 14K to thereby adjust the slide 16 back and forth along the machine slide surface 14S to adjust the spacing between the impression cylinder 12 and the plate cylinder 18. This adjustment compensates for the thickness of the web W during a printing run. The upper surface of the slide 16 carries a second machine slide surface 16S on which rests a second slide 20 mounting on its uppermost extremity an intermediate ink transfer cylinder 22 which is journaled for rotation on a shaft 22A and which has a cylindrical surface parallel to an in surface contact with the circumference of the plate cylinder 18. The outermost extremity of the second slide 20 is engaged by the innermost extremity of the second adjusting knob 16K such that the relative engagement of the plate cylinder 18 and the intermediate ink transfer cylinder 22 are adjustable by means of the second adjusting knob 16K.

Also mounted on the second slide 20 is an ink fountain 24 into which extends an ink fountain cylinder 26 journaled for rotation on a shaft 26A which in turn is mounted on a third machined slide member 28 which is engaged in a slide slot or third slide surface 20S on the second machine slide 20. The outermost extremity of the machine slide 20 above the point of engagement with the innermost extremity of the second adjusting knob 16K carries a third upstanding bracket 20B through which extends a third adjusting knob assembly 20K whose innermost extremity engages the third machine slide 28 for the purpose of relatively adjusting the degree of surface engagement between the ink fountain cylinder 26 and the intermediate ink transfer cylinder 22.

The impression cylinder 12 is usually driven by a miter type gear box with bevel gears or through a gear train on a main machine drive of the equipment. The plate cylinder 18 is driven by suitable gearing (not shown) mounted on the journal of the impression cylinder 12 and engaging a gear mounted on the journal of the plate cylinder 18 (for example). The ink transfer cylinder 22 is likewise driven by gears extending between the plate cylinder 18 and its own shaft end journals and likewise the ink fountain cylinder 26 is driven from the ink transfer cylinder 22 by suitable journal mounted gear means.

In operation, the ink within the ink fountain 24 is picked up by the ink fountain cylinder and transferred to the ink transfer cylinder. The ink fountain cylinder 26 is adjustable with respect to the ink transfer cylinder 22 in order to control the thickness of the film of ink ultimately resulting on the surface of the ink transfer cylinder 22. This adjustment made by the third adjusting knob unit 20K is usually made on both sides or ends of the fountain cylinder to allow the operator to squeeze the ink to the desired film thickness by adjusting one side or the other of the ink fountain cylinder relative to the ink transfer cylinder 22. These cylinders are then moved as a unit, with the second slide means 20 and the knob or knob units 16K which are preferably mounted on adjustment knob means on each side of the machine slide 20 such that each end of the ink transfer cylinder 22 can be adjusted relative to the plate cylinder 18 to squeeze one side or the other with the various adjusting knob means 16K. Then, the entire group of the plate cylinder 18, ink transfer cylinder 22 and ink fountain cylinder 28 are adjusted by the first adjusting knob units 14K which are preferably located one on each side of the first machine slide 16 to adjust both ends of the plate cylinder 18 with respect to the surface of the impression cylinder 12. All of the machined slides are adjustable in respectively parallel planes.

Thus, there are a multitude of adjustments which can be fraught with inaccuracies as previously defined with regard to the background of the present invention and the following description of the present invention clearly illustrates how the objectionable characteristics of the prior art have been overcome.

Referring now to FIGS. 2 and 3, a flexographic printing unit 100 is illustrated as including vertical side plates 102A and 102B which are mutually parallel and of substantially identical configuration. The side plates 102A and 102B are maintained in a rigid and mutually parallel configuration with their identical portions indexed by means of a plurality of cross braces or rods 104A, 104B and 104C which extend across the space between the side plates to maintain these plates in a rigid and precise configuration.

The assembly of side plates 102A, 102B and the cross braces 104A . . . C are all supported on a suitable machine bed MB which is schematically shown in FIG. 3.

As can immediately be seen from FIG. 2, there is no ink fountain cylinder and intermediate ink transfer cylinder in the context of the cylinders 28 and 22 of FIG. 1. Rather, there is an ink fountain 106 suitably mounted on a cross-bar 106A (FIG. 3) and an ink transfer cylinder 108 suspended between the side plates 102A and 102B by means to be hereinafter more fully described and which are included in the ends of pivoted mounting arms 108A and 108B, the latter adjustably pivoted about the support rod 104B by means of pneumatic or hydraulic cylinders 108C and 108D such that the ink fountain 106 and ink transfer cylinder 108 move as a unit.

In FIG. 2 the pivot arm 108B is illustrated as having a bell crank type configuration pivoted about the cross brace or support rod 104B at its center and having the hydraulic cylinder 108D driving the opposite end from which the ink transfer cylinder 108 is mounted. In FIG. 3, however, the swinging arms 108A and 108B are illustrated as elongated rectangular arms pivoted at one end to the cross brace 104B and having the cylinders 108C and 108D driving them, respectively, at their free ends, with the ink transfer cylinder 108 being journaled intermediate the ends thereof as will be hereinafter more fully described.

The plate cylinder 110 is fixedly mounted between the side plates 102A and 102B by means of a shaft 110S which is rotatable in suitable journal bearings in the side plates as will be hereinafter more fully described with reference to FIG. 3. The plate cylinder 110 is mounted in close proximity to the ink transfer cylinder 108 such that the relevent degree of engagement or gapping between these two cylinders is ultimately adjustable to control the thickness of the ink film transferred from the ink transfer cylinder 108 to the plate cylinder 110.

The impression cylinder 112 is mounted to be freewheeling on its own shaft 112S as will be hereinafer more fully described and is mounted by means of this shaft at the lowermost ends of dependent swinging arms 112A and 112B, the latter being respectively pivoted at the uppermost ends thereof to opposite ends of the cross brace or cross brace rods 104C. The swinging arms 112A and 112B are driven to selectively adjustable positions by hydraulic or pneumatic cylinders 112C and 112D, respectively, the latter having actuating rods extending therefrom and joining with the swinging arms 112A and 112B intermediate the ends thereof in a conventional manner.

The impression cylinder 112 is in substantial line contact with the plate cylinder 110 such that a web W to be printed is nipped therebetween as schematically shown in FIG. 2.

The thickness of the ink film to be transferred from the ink transfer cylinder 108 to the plate cylinder 110 is controlled by an adjustable doctor blade 114 which is generally shown in FIG. 2 and which will be more fully described with reference to FIG. 3.

The impression cylinder 112 is also provided with a fine adjustment in addition to the basic adjustment made possible by the swinging arms 112A and 112B and the adjusting cylinders 112C and 112D. This adjustment is illustrated in FIG. 3 as a cylindrical bushing 112E which is eccentrically mounted for rotation with the impression cylinder shaft 112S by means of a split collar 112F. The adjustment of the rotational position of the impression cylinder shaft 112S is made by means of a shaft mounted gear means 112G cooperating with a worm type adjusting knob 112H which is mounted in a suitable mounting block 112J on the inner or front surface of the swinging arm 112A as illustrated in the left-hand portion of FIG. 3. Accordingly, rotation of the worm type knob assembly 112H causes rotation of the gear 112G and the shaft 112S together with the collar 112F and eccentric bushing 112E to cause shifting of the impression cylinder 112 by means of a freewheeling bearing 112K concentrically mounted about the exterior of the eccentric bushing 112E, to render the impression cylinder 112 freewheeling thereon, such that the gap between the circumference of the impression cylinder 112 and the circumference of the plate cylinder 110 is selectively adjustable to provide varying degrees of nip on the web W (FIG. 2) being printed.

Concentric bushing 112E is duplicated at both ends of the impression cylinder 112 as is the freewheeling externally concentric bearing 112K such that the impression cylinder 112 is uniformally mounted in freewheeling relationship to the eccentric bushings 112E and the impression cylinder shaft 112S.

Also mounted on opposite ends of the impression cylinder shaft 112S in suitable apertures 112L are bearing traction rollers 112M mounted one on either end of the said shaft 112S for peripheral engagement with a like pair of bearing traction rolls 110M, the latter being on opposite ends of the plate cylinder shaft 110S and keyed thereto for rotation therewith externally of each of the side plates 102A and 102B.

Likewise, the ink transfer cylinder 108 is provided with a transfer cylinder shaft 108S which protrudes of both the side plates 102A and 102B and which carries keyed bearing traction rollers 108M on opposite ends thereof for peripheral engagement with the bearing transfer rollers 100M on the plate cylinder shaft 110S.

The left-hand portion of FIG. 3 is the only portion of that Figure which illustrates the details of interdependence of the various bearing rollers 108M, 110M and 112M but the identical configuration is provided on the opposite side of the drawing on the external portion of the plate 102B.

The plate cylinder shaft 110S is mounted in removable journal blocks 110A and 110B which sit in rectangular step portions of each of the side plates 102A and 102B, respectively. The bearing traction roller 110M outboard of the side plate 102B and journal block 110B is illustrated in FIG. 3 and from that component, the plate cylinder shaft 110S extends outwardly to a shaft coupling SC through which it is attached to an output shaft 50 of a cone drive gear box CD which in turn is driven by a main shaft MS which extends to a main machine drive unit (not shown) as conventional in the art. Thus, the drive assembly for the flexographic printing unit 100 is basically the plate cylinder 110 and the plate cylinder input shaft 110S, with the bearing traction rolls 110M on the latter comprising the input gearing means for causing rotation of the ink transfer cylinder 108 by means of the frictional engagement of the bearing traction rolls 108M with the bearing rolls 110M.

Rotation to the impression cylinder 112 is imparted by the surface of the cylinder 110 through the frictional engagement with the web W (FIG. 2) to be printed and the bearing traction rollers 112M, being freewheeling, are utilized to maintain a precision limit stop for the rough adjustment of the gapping between the surfaces of the impression cylinder 112 and the plate cylinder 110 by precluding the adjusting cylinders 112C and 112D from swinging the arms 112A and 112B too close to the plate cylinder 110.

The adjustment for engagement pressure between the ink transfer roller 108 and the plate cylinder 110 is achieved by the hydraulic or pneumatic cylinders 108C and 108D acting on the ends of the arms 108A and 108B to raise and lower the ink transfer cylinder 108 with respect to the plate cylinder 110.

The thickness of the ink film being transferred between the roller 108 and the roller 110 is governed by an adjustable doctor blade 114 which is pivoted on a bracket means 114A and adjusting knob 114B all mounted on the ink fountain 106 such that the doctor blade 114 is moved towards and away from the surface of the ink transfer roller 108 to scrape away ink picked up from the ink fountain 106 to thereby govern the thickness of the film to be transferred from the transfer cylinder 108 to the plate cylinder 110.

Once the foregoing adjustments have been made between the transfer cylinder 108 and the doctor blade 114, the transfer cylinder 108 and the plate cylinder 110 and between the plate cylinder 110 and the impression cylinder 112, the flexographic printing unit 100 is then adjusted to properly accommodate the thickness of the web W (FIG. 2) being fed between the impression cylinder 112 and the plate cylinder 110 by adjusting the worm type adjusting knob 112H to thereby rotate the eccentric 112E and cause a shifting of the axis of free rotation of the impression cylinder 112 toward or away from the axis of rotation of the plate cylinder 110 to thereby adjust the gap between the surfaces of these respective cylinders to accommodate the thickness of the web W.

As can be seen from the foregoing specification and drawings, the present invention has provided a means whereby only four basic adjustments need now be made and in which all requisites for machine slides and machine surfaces have been eliminated with the exception of the external surfaces of the bearing and traction rollers and the eccentric bushings 112E and bearings 112K cooperating therewith.

Furthermore, cone drive gearing is utilized which is wellknown as being a type of gearing which materially reduces backlash and which in any event does not pose a problem since the bearing and traction rolls 108M, 110M and 112M are all precision-ground, friction type gearing which does not suffer from the backlash problem.

Since the plate cylinder 110 is also the driving cylinder, then the indexing of the matter to be printed with the travelling web is self-regulating.

Furthermore, the bearing traction rolls 108 . . . 112M being precision-ground, can either be ground on a one-to-one basis consistent with the peripheral dimensions of their respectively associated cylinders or can be ground to a size having a desired gear ratio to be effectuated between the said cylinders.

The first fluid actuators 108C and 108D may be energized through a first common control valve CV1 from a first source of control pressure CP1 and the second fluid actuators 112C and 112D may be energized through a second common control valve CV2 from a second source of control pressure CP2 as schematically illustrated in FIG. 3. Such control valves are conventional in the art and need not be further disclosed herein. This actuation from a common control means ensures uniformity across the entire surfaces of the various cylinders in the printing unit.

FIGS. 4 through 8 illustrate an embodiment of the flexographic printing unit of the present invention which includes an adjusting knob 210A for changing the registration of the print-to-blank or print-to-print of the plate cylinder 110 as it engages the web W.

Figure 4:
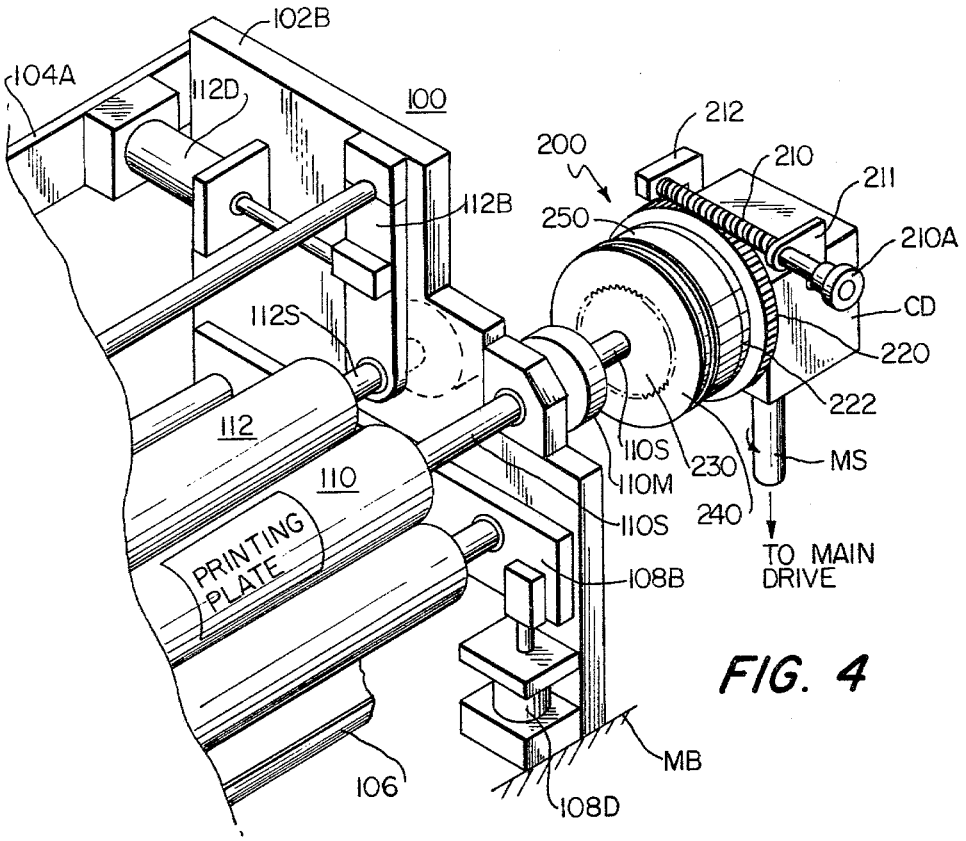
FIG. 4 is a perspective view of a second embodiment of a flexographic printing unit of the present invention which includes a planetary gear drive unit.

Like numerals illustrated in FIG. 4 correspond to like elements illustrated in FIGS. 2 and 3. FIG. 4 further includes a planetary gear unit 200 which may be adjusted by means of the worm gear 210. The cone drive CD housing includes two upwardly projecting support members 211 and 212. The support members position the worm gear 210 in meshing engagement with the registration adjusting gear 220. The registration adjusting gear 220 is affixed to the registration housing 222.

The planetary gear unit 200 includes an output housing 250 and a planetary output gear 240. The planetary output gear 240 is in meshing engagement with the plate cylinder gear 230 which is affixed to the plate cylinder shaft 110S.

Power is supplied to the flexographic printing unit 100 by means of the main shaft MS, the cone drive CD and the planetary gear unit 200. The registration of the print-to-blank or the print-to-print of the plate cylinder 110 relative to the web W may be adjusted by means of the registration adjusting knob 210A. Rotating the registration adjusting knob 210A transmits motion to the worm gear 210 which imparts motion to the registration adjusting gear 220 to change the registration of the plate cylinder 110 relative to the web W. The registration adjusting feature of an embodiment of the flexographic printing unit of the present invention will be discussed in detail with reference to FIGS. 5 through 8.

Figure 7:
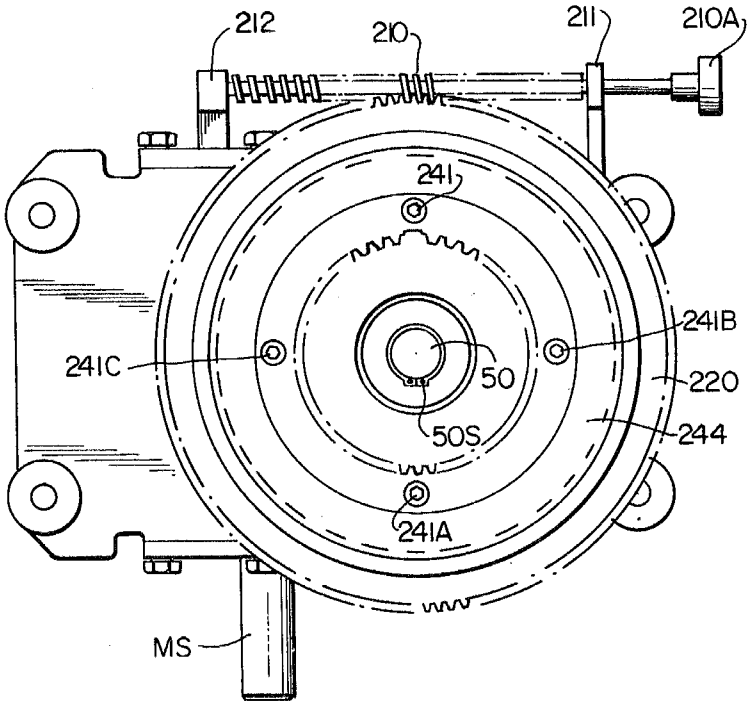
FIG. 7 is a front view of the planetary drive and adjusting mechanism of the second embodiment of a flexographic printing unit of the present invention.
Figure 5:
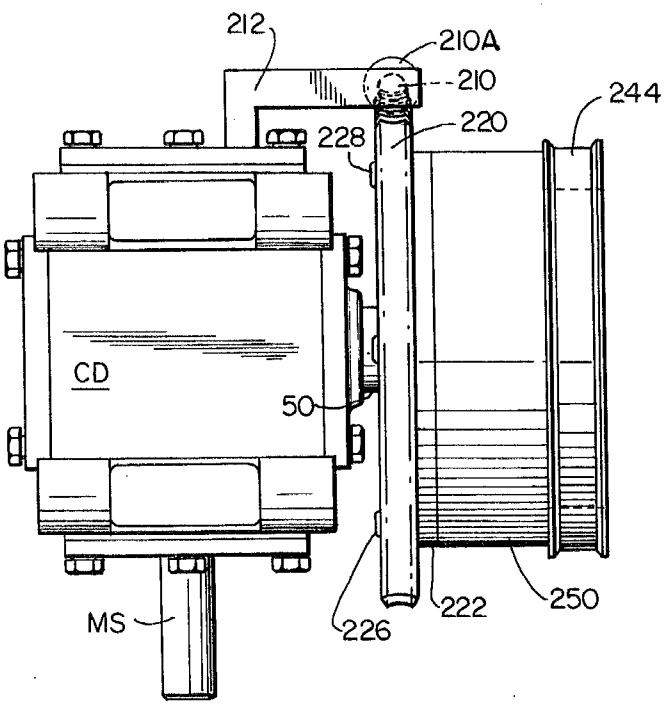
FIG. 5 is a side view of the cone drive gear box and planetary gear drive unit of the second embodiment of a flexographic printing unit of the present invention.

FIGS. 5 and 7 illustrate side and front views, respectively, of the planetary gear unit illustrated in FIG. 4. As previously discussed, the main shaft MS is connected to the cone drive gear box CD which includes an output shaft 50. The output shaft 50 is connected to a planetary gear unit 200 for transmitting rotary motion to the plate cylinder gear 230 which is connected to the plate cylinder shaft 110S. During operation, the output shaft 50 imparts rotary motion to the output housing 250 which in turn imparts rotary motion to the planetary output gear 240. The registration housing 222 and the registration adjusting gear 220 are normally stationary with respect to the output housing 250.

Figure 6:
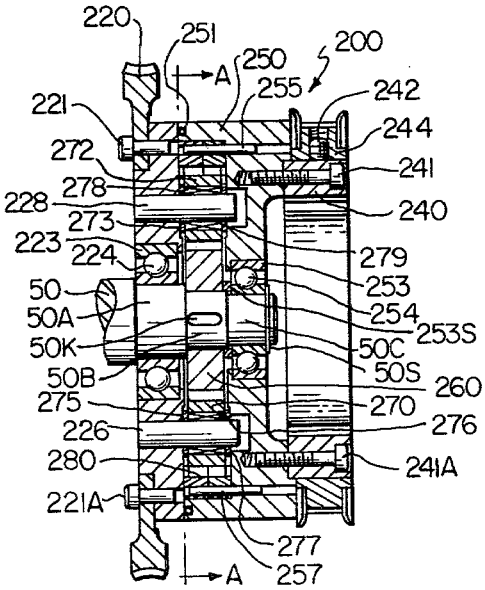
FIG. 6 is a cross-sectional view of the planetary gear drive unit illustrated in FIGS. 4 and 5.

A pulley support 244 is removably affixed to the planetary output gear 240 by means of the set screw 242. Further, the planetary output gear 240 is removably affixed to the output housing 250 by means of the bolts 241, 241A, 241B and 241C. As illustrated in FIGS. 6 and 7, the planetary gear unit 200 is mounted on the output shaft 50 and affixed thereto by means of the spring clip 50S.

As illustrated in FIG. 6, the planetary gear unit 200 includes a registration adjusting gear 220 which is affixed to the registration housing 222 by means of bolts 221 and 221A. The registration housing 222 is mounted on a bearing 223. The bearing 223 is pressfit onto a reduced portion 50A of the output shaft 50. The bearing 223 may include a plurality of ball bearings 224 but is not specifically limited to this type of bearing.

A sun gear 260 is mounted on a reduced portion 50B of the output shaft 50. The sun gear may be keyed to the reduced portion 50B by means of the key member 50K. Mounting the bearing 223 of the registration housing 222 on a first reduced portion 50A and the sun gear 260 on a second reduced portion 50B maintains the spacing of the registration housing with respect to the sun gear and the output housing 250.

The planet gears 270 and 272 are orbitably rotatable on pins 226 and 228, respectively. The planet gear 270 is rotatably mounted on a pin 226 by means of the bearing 276. Spacers 276 and 277 maintain the spacing of the planet gear 270 with respect to the registration housing 222 and the output housing 250, respectively.

The planet gear 272 is rotatably mounted on a pin 228 through a bearing 278. Spacers 273 and 279 maintain the spacing of the planet gear 272 with respect to the registration housing 222 and the output housing 250, respectively.

Figure 8:
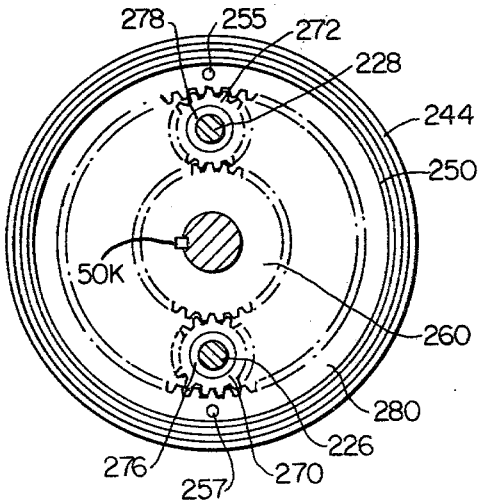
FIG. 8 is a cross-sectional view taken along line A—A of FIG. 6.

As illustrated in FIGS. 6 and 8, the sun gear 260 is in meshing engagement with the planet gears 270 and 272 which in turn mesh with the internal ring gear 280. Rotary motion imparted to the sun gear 260 rotates the planet gears 270 and 272 which in turn impart rotary motion to the internal ring gear 280. The internal ring gear 280 is affixed to the output housing 250 by means of the pins 255 and 257. The output housing 250 is mounted on a reduced portion 50C of the output shaft 50 through a bearing 253. The bearing 253 is illustrated to include a plurality of ball bearings 254 but is not limited to this particular type of bearing. A spacer 253S maintains the spacing of the bearing 253 with respect to the sun gear 260. Further, an O-ring 251 maintains a seal between the output housing 250 and the registration housing 222.

The planetary output gear 240 is affixed to the output housing 250 by means of the bolts 241, 241A, 241B and 241C. A pulley support 244 is affixed to the planetary output gear 240 by means of a set screw 242.

OPERATION OF THE REGISTRATION ADJUSTING

In operation, rotary motion is imparted to the sun gear 260 by means of the output shaft 50. The sun gear 260 rotates the planetary gears 270 and 272 which in turn impart rotary motion to the internal ring gear 280. Since the output housing 250 is affixed to the internal ring gear 280, the rotary motion of the internal ring gear 280 is imparted to the output housing 250. In a similar manner, since the output housing 250 is affixed to the planetary output gear 240, rotary motion of the output housing 250 is imparted to the planetary output gear 240.

The plate cylinder gear 230 is in meshing engagement with the planetary output gear 240 and imparts rotary motion therefrom to the plate cylinder shaft 110S. The rotary motion of the plate cylinder shaft 110S imparts rotation to the plate cylinder 110. A web W passes through a nip between the cylinders 110 and 112 and the image on the printing plate is impressed thereon.

To register the printing plate with the web W, it may be necessary to slightly advance or set back the printing plate 110. The web W may include a printed indicia thereon which would require the printing plate to be properly registered with respect to the previously printed indica. The registration adjusting member of the embodiment of the flexographic printing unit of the present invention facilitates the registration of the print-to-blank or print-to-print of the plate cylinder 110.

The planetary gear unit 200 includes a registration housing 222 which is normally stationary with respect to the output housing 250. The registration housing 222 is mounted on the output shaft 50 through a bearing 223 which permits the registration housing to remain stationary with respect to the output housing 250. The registration adjusting gear 222 is mounted on the registration housing 222. By rotation the registration adjusting knob 210A motion is imparted to the worm gear 210 which transmits motion to the registration adjusting gear 220 which changes the relative position of the pins 226 and 228 of the planetary gears 270 and 272, respectively. By changing the position of the pins 226 and 228 an additional motion is imparted to the planetary gears 270 and 272 which in turn imparts an additional motion to the internal ring gear 280. This additional motion imparted to the internal ring gear 280 is transmitted through the planetary gear unit to the plate cylinder 110 to change the registration of the printing plate with respect to the web W.

An operator of the flexographic printing unit 100 would merely incrementally rotate the registration adjusting knob 210A to impart motion to the registration adjusting gear 220 thereby changing the registration of the printing plate positioned on the plate cylinder 110 until the proper registration of the print-to-blank or print-to-print was obtained.

Although the planetary gear unit illustrated in FIGS. 4 through 8 disclose the use of two planetary gears, additional planetary gears may be utilized if necessary.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. In a printing means for printing repetitive patterns on a travelling web printing medium, including a driven printing plate cylinder and inking and impression cylinders driven thereby, all of said cylinders being substantially mutually parallel and positioned between upstanding spaced side plates on a machine frame, the improvement comprising:

an integral axial shaft on said inking cylinder;

a first pair of swinging arms pivotally mounted between said side plates and journalling opposite ends of said integral inking cylinder shaft for rotation therein;

first fluid actuating means selectively positioning said first swinging arms and said inking cylinder with respect to said plate cylinder;

an axial mounting shaft in said impression cylinder;

a second pair of swinging arms pivotally mounted between said side plates and journalling said mounting shaft for limited rotation therein;

second fluid actuating means selectively positioning said second swinging arms and said impression cylinder with respect to said plate cylinder;

fine adjustment means for said impression cylinder comprising a cylindrical bushing eccentric with said axial mounting shaft within each end of said impression cylinder, bearing means mounting said impression cylinder for free rotation on said bushings and adjusting means on at least one of said arms for imparting a selected rotational adjustment to said mounting shaft and said bushings to cause selective translation of said impression cylinder toward and away from said place cylinder;

an integral axial drive shaft on said plate cylinder; and bearing traction means on opposite ends of each of said shafts interengaged to drive said inking cylinder therethrough and to index said inking and impression cylinders with respect to said plate cylinder;

said impression cylinder being freewheeling to be driven by said plate cylinder through web of printing medium nipped therebetween.

2. The printing means of claim 1, wherein said bearing traction means comprise precision-ground rollers having predetermined dimensions compatible with relative rotation of said cylinders and the desired spacing therebetween;

the bearing traction rollers on said inking cylinder and plate cylinder shafts being keyed thereto for rotation therewith; and the bearing traction rollers on said impression cylinder mounting shaft being freewheeling thereon.

3. The printing means of claim 1, which further includes:

an ink fountain means for supplying ink to said inking cylinder; and adjustable doctor blade means mounted on said first pair of swinging arms for controlling the thickness of printing ink film on said inking cylinder.

4. The printing means of claim 3, wherein said bearing traction means comprise precision-ground rollers having predetermined dimensions compatible with relative rotation of said cylinders and the desired spacing therebetween;

the bearing traction rollers on said inking cylinder and plate cylinder shafts being keyed thereto for rotation therewith; and the bearing traction rollers on said impression cylinder mounting shaft being freewheeling thereon.

5. The printing means of claim 1, wherein said first fluid actuating means comprises first and second fluid actuating cylinders independently actuating respective ones of the arms of said first pair of swinging arms and actuated from a first common control means;

wherein said second fluid actuating means comprises third and fourth fluid actuating cylinders independently actuating respective ones of the arms of said second pair of swinging arms and actuated from a second common control means; and said swinging arms thereby providing uniform adjustments between the surfaces of said plate, impression and inking cylinders.

6. The printing means of claim 5, wherein said bearing traction means comprise precision-ground rollers having predetermined dimensions compatible with relative rotation of said cylinders and the desired spacing therebetween;

the bearing traction rollers on said inking cylinder and plate cylinder shafts being keyed thereto for rotation therewith; and the bearing traction rollers on said impression cylinder mounting shaft being freewheeling thereon.

7. The printing means of claim 5, which further includes:

an ink fountain means for supplying ink to said inking cylinder; and adjustable doctor blade means mounted on said first pair of swinging arms for controlling the thickness of printing ink film on said inking cylinder.

8. The printing means of claim 7, wherein said bearing traction means comprise precision-ground rollers having predetermined dimensions compatible with relative rotation of said cylinders and the desired spacing therebetween:

the bearing traction rollers on said inking cylinder and plate cylinder shafts being keyed thereto for rotation therewith; and the bearing traction rollers on said impression cylinder mounting shaft being freewheeling thereon.

9. Printing means for printing successive patterns on a travelling web of printing medium comprising:

a machine base with upstanding side plates;

plate cylinder means journalled for rotation between said side plates in a fixed axial position and including a plate cylinder surface and a shaft rotatable therewith having first bearing traction rollers keyed thereto for rotation in synchronism with said plate cylinder surface;

drive means rotating said plate cylinder shaft;

an ink fountain mounted between said side plates adjacent said plate cylinder; and ink transfer cylinder means mounted between said side plates intermediate said plate cylinder means and said ink fountain means for transferring ink from the latter to the former;

said ink transfer cylinder means being substantially parallel to said plate cylinder and including:

a coaxial integral shaft rotatable therewith, first and second swinging arm means pivoted to respective ones of said side plates and being driven about said pivots by first and second fluid actuating means, journal means mounting opposite ends of said coaxial integral shaft in respective ones of said swing arm means, and second bearing traction rollers keyed on opposite ends of said coaxial integral shaft in driving engagement with said first bearing traction rollers on said plate cylinder shaft; and an impression cylinder means mounted for free rotation between said side plates and having a cylindrical impression surface substantially parallel with and cooperating with said plate cylinder means to nip a web of printing medium therebetween;

said impression cylinder means including:

an interior mounting shaft substantially parallel to the central axis of said cylindrical impression surface, thrid and fourth swinging arm means including journal means mounting opposite ends of said mounting shaft for rotation therein pivoted to said respective ones of said side plate means and being driven about pivots by third and fourth fluid actuating means, third bearing traction rollers freely rotatable on opposite ends of said mounting shaft and engaged with said first bearing traction rollers to initially index said cylindrical impression surface with said plate cylinder surface, eccentric bearing means on said mounting shaft adjustably mounting said cylindrical impression surface for free rotation eccentrically of said mounting shaft, and mounting shaft engaging means precluding free rotation thereof and providing selective rotational positioning thereof and of said eccentric bearing means to provide a fine nip adjustment between said impression surface and said plate cylinder surface.

10. In a printing means for printing repetitive patterns on a travelling web printing medium, including a driven printing plate cylinder and inking and impression cylinders driven thereby, all of said cylinders being substantially mutually parallel and positioned between upstanding spaced side plates on a machine frame, the improvement comprising:

an integral axial shaft on said inking cylinder;

a first pair of swinging arms pivotally mounted between said side plates and journalling opposite ends of said integral inking cylinder shaft for rotation therein;

first fluid actuating means selectively positioning said first swinging arms and said inking cylinder with respect to said printing plate cylinder;

an axial mounting shaft in said impression cylinder;

a second pair of swinging arms pivotally mounted between said side plates and journalling said mounting shaft for limited rotation therein;

second fluid actuating means selectively positioning said second swinging arms and said impression cylinder with respect to said printing plate cylinder;

fine adjustment means for said impression cylinder comprising a cylindrical bushing eccentric with said axial mounting shaft within each end of said impression cylinder, bearing means mounting said impression cylinder for free rotation on said bushings and adjusting means on at least one of said arms for imparting a selected rotational adjustment to said mounting shaft and said bushings to cause selective translation of said impression cylinder toward and away from said printing plate cylinder;

an integral axial drive shaft on said printing plate cylinder;

a registration adjusting means for adjusting the registration of said printing plate cylinder relative to said travelling web; and bearing traction means on opposite ends of each of said shafts interengaged to drive said inking cylinder therethrough and to index said inking and impression cylinders with respect to said printing plate cylinder;

said impression cylinder being freewheeling to be driven by said printing plate cylinder through web of printing medium nipped therebetween.

11. The printing means of claim 10, wherein said bearing traction means comprise precision-ground rollers having predetermined dimensions compatible with relative rotation of said cylinders and the desired spacing therebetween;

the bearing traction rollers on said inking cylinder and plate cylinder shafts being keyed thereto for rotation therewith; and the bearing traction rollers on said impression cylinder mounting shaft being freewheeling thereon.

12. The printing means of claim 10, which further includes:

an ink fountain means for supplying ink to said inking cylinder; and adjustable doctor blade means mounted on said first pair of swinging arms for controlling the thickness of printing ink film on said inking cylinder.

13. The printing means of claim 12, wherein said bearing traction means comprise precision-ground rollers having predetermined dimensions compatible with relative rotation of said cylinders and the desired spacing therebetween;

the bearing traction rollers on said inking cylinder and plate cylinder shafts being keyed thereto for rotation therewith; and the bearing traction rollers on said impression cylinder mounting shaft being freewheeling thereon.

14. The printing means of claim 10, wherein said first fluid actuating means comprises first and second fluid actuating cylinders independently actuating respective ones of the arms of said first pair of swinging arms and actuated from a first common control means;

wherein said second fluid actuating means comprises third and fourth fluid actuating cylinders independently actuating respective ones of the arms of said second pair of swinging arms and actuated from a second common control means; and said swinging arms thereby providing uniform adjustments between the surfaces of said plate, impression and inking cylinders.

15. The printing means of claim 14, wherein said bearing traction means comprise precision-ground rollers having predetermined dimensions compatible with relative rotation of said cylinders and the desired spacing therebetween;

the bearing traction rollers on said inking cylinder and plate cylinder shafts being keyed thereto for rotation therewith; and the bearing traction rollers on said impression cylinder mounting shaft being freewheeling thereon.

16. The printing means of claim 14, which further includes:

an ink fountain means for supplying ink to said inking cylinder; and adjustable doctor blade means mounted on said first pair of swinging arms for controlling the thickness of printing ink film on said inking cylinder.

17. The printing means of said claim 16, wherein said bearing traction means comprise precision-ground rollers having predetermined dimensions compatible with relative rotation of said cylinders and the desired spacing therebetween;

the bearing traction rollers on said inking cylinder and plate cylinder shafts being keyed thereto for rotation therewith; and the bearing traction rollers on said impression cylinder mounting shaft being freewheeling thereon.

18. The printing means of claim 10, wherein the registration adjusting means includes a planetary drive gear unit adapted to engage said axial drive shaft on said printing plate cylinder.

19. The printing means of claim 18, wherein said planetary drive gear unit includes at least one planet gear mounted on a registration adjusting gear whereby an incremental rotation of said registration adjusting gear imparts an incremental additional motion to said printing plate cylinder.

20. The printing means of claim 19, wherein said incremental additional motion changes the registration of said printing plate cylinder relative to said travelling web.

21. The printing means of claim 19, wherein said planetary drive unit includes two planet gears.

22. The printing means of claim 19, wherein said planetary drive gear unit includes an output gear and said registration adjusting gear is normally held stationary with respect to said output gear.

23. The printing means of claim 19, wherein said registration adjusting gear is rotated by means of a worm gear.

24. Printing means for printing successive patterns on a travelling web of printing medium comprising:

a machine base with upstanding side plates;

plate cylinder means journalled for rotation between said side plates in a fixed axial position and including a plate cylinder surface and a shaft rotatable therewith having first bearing traction rollers keyed thereto for rotation in synchronism with said plate cylinder surface;

drive means rotating said plate cylinder shaft;

a registration adjusting means for adjusting the registration of said plate cylinder surface relative to said travelling web;

an ink fountain mounted between said side plates adjacent said plate cylinder; and ink transfer cylinder means mounted between said side plates intermediate said plate cylinder means and said ink fountain means for transferring ink from the latter to the former;

said ink transfer cylinder means being substantially parallel to said plate cylinder and including:

a coaxial integral shaft rotatable therewith, first and second swinging arm means pivoted to respective ones of said side plates and being driven about said pivots by first and second fluid actuating means, journal means mounting opposite ends of said coaxial integral shaft in respective ones of said swing arm means, and second bearing traction rollers keyed on opposite ends of said coaxial integral shaft in driving engagement with said first bearing traction rollers on said plate cylinder shaft; and an impression cylinder means mounted for free rotation between said side plates and having a cylindrical impression surface substantially parallel with and cooperating with said plate cylinder means to nip a web of printing medium therebetween;

said impression cylinder means including:

an interior mounting shaft substantially parallel to the central axis of said cylindrical impression surface, third and fourth swinging arm means including journal means mounting opposite ends of said mounting shaft for rotation therein pivoted to said respective ones of said side plate means and being driven about pivots by third and fourth fluid actuating means, third bearing traction rollers freely rotatable on opposite ends of said mounting shaft and engaged with said first bearing traction rollers to initially index said cylindrical impression surface with said plate cylinder surface, eccentric bearing means on said mounting shaft adjustably mounting said cylindrical impression surface for free rotation eccentrically of said mounting shaft, and mounting shaft engaging means precluding free rotation thereof and providing selective rotational positioning thereof and of said eccentric bearing means to provide a fine nip adjustment between said impression surface and said plate cylinder surface.

25. A printing apparatus for printing repetitive patterns on a travelling web printing medium, including a driven printing plate cylinder and inking and impression cylinders driven thereby, all of said cylinders being substantially mutually parallel and positioned between upstanding spaced side plates on a machine frame, the improvement comprising:

an integral axial shaft on said inking cylinder;

a first pair of swinging arms pivotally mounted between said plates and journalling opposite ends of said integral inking cylinder shaft for rotation therein;

first fluid actuating means selectively positioning said first swinging arms and said inking cylinder with respect to said printing plate cylinder;

an axial mounting shaft in said impression cylinder;

a second pair of swinging arms pivotally mounted between said side plates and journalling said mounting shaft for limited rotation therein;

second fluid actuating means selectively positioning said second swinging arms and said impression cylinder with respect to said printing plate cylinder;

an integral axial drive shaft on said printing plate cylinder;

a registration adjusting means for adjusting the registration of said printing plate cylinder relative to said travelling web; and traction means on opposite ends of each of said shafts for driving said inking cylinder therethrough and to index said inking and impression cylinders with respect to said printing plate cylinder;

said impression cylinder being freewheeling to be driven by said printing plate cylinder with said travelling web of printing medium nipped therebetween.

26. A printing apparatus according to claim 25, wherein the registration adjusting means includes a planetary drive gear unit adapted to engage said axial drive shaft on said printing plate cylinder.

27. A printing apparatus according to claim 26, wherein said planetary drive gear unit includes at least one planet gear mounted on a registration adjusting gear whereby an incremental rotation of said registration adjusting gear imparts an incremental additional motion to said printing plate cylinder.

28. A printing apparatus according to claim 27, wherein said incremental additional motion changes the registration of said printing plate cylinder relative to said travelling web.

29. A printing apparatus according to claim 27, wherein said planetary drive unit includes two planet gears.

30. A printing apparatus according to claim 27, wherein said planetary drive gear unit includes an output gear and said registration adjusting gear is normally held stationary with respect to said output gear.

31. A printing apparatus according to claim 27, wherein said registration adjusting gear is rotated by means of a worm gear.

32. A printing apparatus for printing repetitive patterns on a travelling web printing medium, including a driven printing plate cylinder and inking and impression cylinders driven thereby, all of said cylinders being substantially mutually parallel and positioned between upstanding spaced side plates on a machine frame, the improvement comprising:

a first axial shaft rotatable with said inking cylinder;

a first adjustable mounting means mounted between said side plates and journalling opposite ends of said first axial shaft for rotation therein;

first actuating means selectively positioning said first adjustable mounting means and said inking cylinder with respect to said printing plate cylinder;

an axial mounting shaft in said impression cylinder;

second adjustable mounting means mounted between said side plates and journalling said mounting shaft for limited rotation therein;

second actuating means selectively positioning said second adjustable mounting means and said impression cylinder with respect to said printing plate cylinder;

an axial drive shaft rotatable with said printing plate cylinder;

a registration adjusting means for adjusting the registration of said printing plate cylinder relative to said travelling web; and traction means on opposite ends of each of said shafts for driving said inking cylinder therethrough and to index said inking and impression cylinders with respect to said printing plate cylinder;

said impression cylinder being free-wheeling to be driven by said printing plate cylinder with said travelling web of printing medium nipped therebetween.

* * * * *